US007823511B2

(12) United States Patent
Lins et al.

(10) Patent No.: US 7,823,511 B2
(45) Date of Patent: Nov. 2, 2010

(54) INSTALLATION FOR CONVEYING INDIVIDUALS

(75) Inventors: Stephan Lins, Feldkirch (AT); Reinhard Albrich, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 365 days.

(21) Appl. No.: 11/945,676

(22) Filed: Nov. 27, 2007

(65) Prior Publication Data

US 2008/0229967 A1 Sep. 25, 2008

(30) Foreign Application Priority Data

Mar. 22, 2007 (AT) ..... A 457/2007

(51) Int. Cl.
*B61B 3/00* (2006.01)

(52) U.S. Cl. ..... 104/127; 104/87; 104/129

(58) Field of Classification Search ..... 104/53, 104/66, 87, 173.1, 127, 128, 129
See application file for complete search history.

(56) References Cited

U.S. PATENT DOCUMENTS 535,938 A * 3/1895 Boyton ..... 104/70
5,224,425 A * 7/1993 Remington ..... 104/53
6,427,601 B2 * 8/2002 Albrich ..... 104/87
6,550,392 B2 4/2003 Albrich
6,857,373 B2 * 2/2005 Checketts et al. ..... 104/53
6,945,839 B2 * 9/2005 Quercetti ..... 446/3
2006/0137563 A1 * 6/2006 Cummins ..... 104/53

FOREIGN PATENT DOCUMENTS

EP 1230962 A1 8/2002

* cited by examiner

*Primary Examiner*—S. Joseph Morano
*Assistant Examiner*—Zachary Kuhfuss
(74) *Attorney, Agent, or Firm*—Laurence A. Greenberg; Werner H. Stemer; Ralph E. Locher

(57) ABSTRACT

An installation conveys individuals by way of a transporting device along a track located above the ground and borne by supports. The installation further has a base station, an apparatus for conveying the transporting device from the base station to a top station, and a running rail for the transporting device which starts from the top station and runs predominantly downward. The running rail extends along curves and loops from the top station to the base station. Provided in the region of the base station, in which the boarding location for the passengers is located, is a conveying tower configured with an upward-conveying apparatus for the transporting device. Located in a region of the top station is a transfer location at which the transporting device occupied by passengers is transferred from the upward-conveying apparatus to the running rail, along which they descend to the base station.

9 Claims, 9 Drawing Sheets

INSTALLATION FOR CONVEYING INDIVIDUALS

CROSS-REFERENCE FOR RELATED APPLICATION

This application claims the priority, under 35 U.S.C. §119, of Austrian application A 457/2007, filed Mar. 22, 2007; the prior application is herewith incorporated by reference in its entirety.

BACKGROUND OF THE INVENTION

Field of the Invention

The present invention relates to an installation for conveying individuals by way of a transporting device along a track which is located above the ground and is borne by supports. The installation further has a base station, an apparatus for conveying the transporting device from the base station to a top station, and a running rail for the transporting device which starts from the top station and runs predominantly downward. The running rail extends along curves and loops from the top station to the base station.

Such an installation, which constitutes an amusement ride, is known from European patent EP 1 230 962 B1. This known amusement ride is provided on sloping terrain. A mountain station, on the one hand, and a valley station, on the other hand, are provided here, and located between the two stations is the running rail which is borne by supports and along which the transporting device occupied by individuals descends from the mountain station to the valley station.

BRIEF SUMMARY OF THE INVENTION

It is accordingly an object of the invention to provide an installation for conveying individuals which overcomes the above-mentioned disadvantages of the prior art devices of this general type, which can be erected on non-sloping terrain, in other words terrain which extends more or less horizontally.

With the foregoing and other objects in view there is provided, in accordance with the invention, an installation for conveying passengers. The installation contains a plurality of supports, a running rail disposed above ground and supported by the supports, a transporting device guided by the running rail, a base station having a boarding location for the passengers and a disembarking location for the passengers, a top station defining a transfer location, and a conveying tower for conveying the transporting device from the base station to the top station. The running rail starts from the top station and runs predominantly downward, the running rail extending along curves and loops from the top station to the base station. The conveying tower has an upward-conveying apparatus for conveying the transporting device occupied by the passengers. At the transfer location of the top station, the transporting device occupied by the passengers is transferred from the upward-conveying apparatus to the running rail, along the running rail the passengers descend to the disembarking location of the base station.

The object is achieved according to the invention in that provided in the region of the base station, in which the boarding location of the passengers is located, is a conveying tower or the like which is configured with an upward-conveying apparatus for the transporting device occupied by passengers. Located in the region of the top station is a transfer location at which the transporting device occupied by passengers is transferred from the conveying tower or the like to the running rail, along which they descend to the base station, and in that the disembarking location for the passengers is located in the base station.

The upward-conveying apparatus is preferably configured with at least one lifting carriage by way of which the transporting device occupied by passengers can be moved from the base station to the top station and the transfer location. The at least one lifting carriage may be configured with a carrying arm for the transporting device, it being possible for the carrying arm to be pivoted in an at least more or less horizontal plane and to pivot the transporting device at least more or less in a plane normal to the lifting movement.

According to a preferred embodiment, the upward-conveying apparatus is configured with two lifting carriages which can be simultaneously adjusted in height in opposite directions. The two lifting carriages can be coupled to one another for movement in opposite directions by a conveying cable, which is guided over a deflecting roller mounted on the lifting tower or the like.

The carrying arm, which is located on the at least one lifting carriage, can preferably be pivoted by use of a guide rail or by motor or by an actuating cylinder. In particular, the two lifting carriages may be assigned two guide rails, which are located on two opposite sides of the lifting tower or the like.

Furthermore, the running rail which leads away from the top station and the running rail which leads into the base station preferably enclose an acute or an obtuse angle with respect to the direction of the lifting movement.

According to a further-preferred embodiment, provided along the running rail are groups of control lugs or the like which are assigned sensors located on the transporting device, and provided on the vehicles are receiving and transmitting devices which are connected, preferably via radio, to a central control unit which is located in a base station and can control the movements of the transporting device located in the installation.

Other features which are considered as characteristic for the invention are set forth in the appended claims.

Although the invention is illustrated and described herein as embodied in an installation for conveying individuals, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
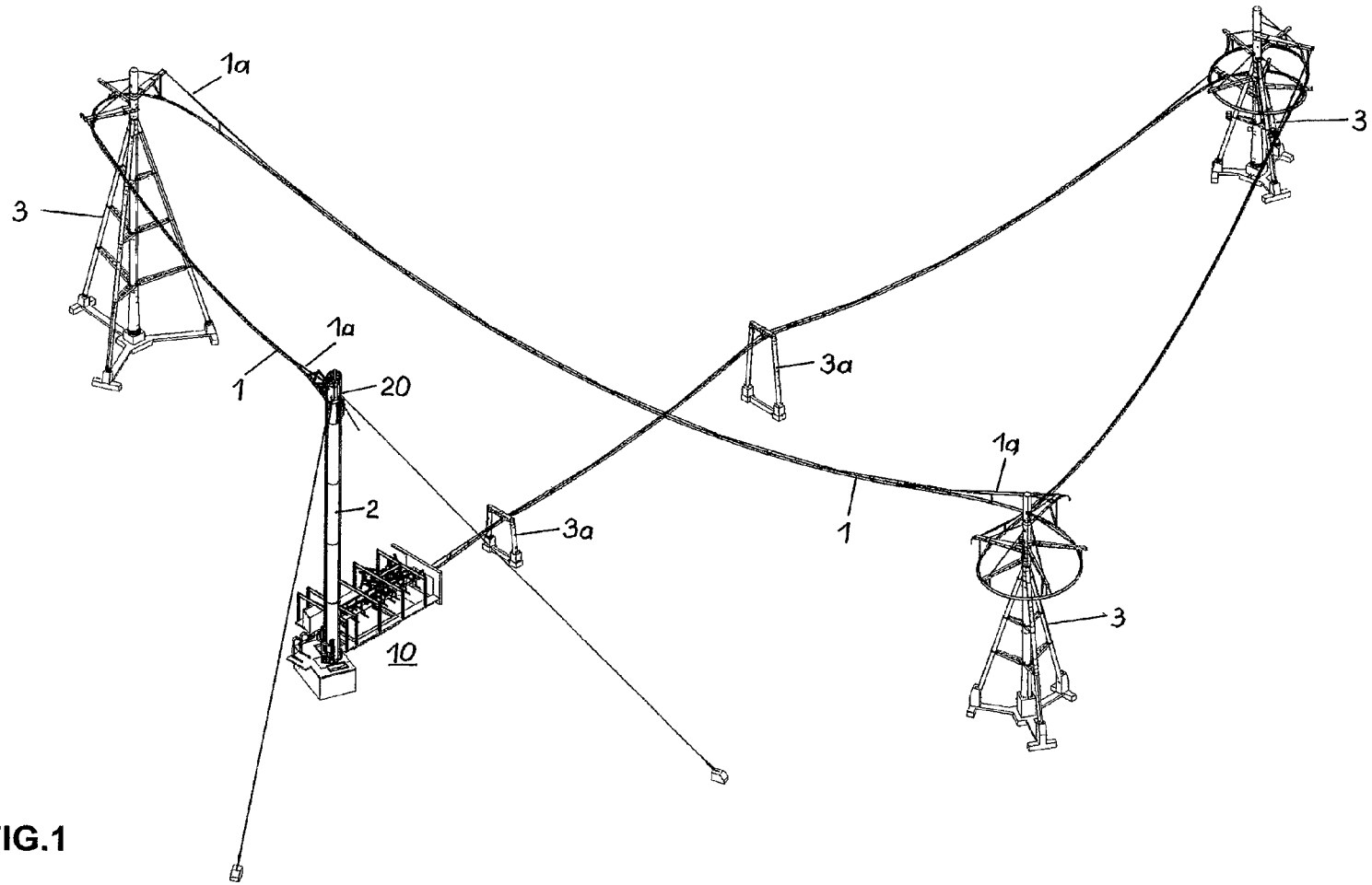
FIG. 1 is an axonometric illustration of an amusement ride according to the invention.

Referring now to the figures of the drawing in detail and first, particularly, to FIG. 1 thereof, there is shown an installation containing a running rail 1, along which non-illustrated vehicles, which form transporting devices for conveying individuals, can be displaced by gravitational force. The running rail 1 starts from a conveying tower 2, which is configured with an upward-conveying apparatus by which the vehicles occupied by passengers are conveyed upward from a base station 10 to a top station 20.

In a top region of the conveying tower 2, the latter has fastened on it a supporting cable 1*a* for the running rail 1, which is additionally borne by further supports 3 and 3*a* and extends via curves and loops from the top station 20 to the base station 10, in which case it runs predominantly downward.

In the base station 10, a respective vehicle is boarded by a number of individuals, whereupon it is conveyed upward along the conveying tower 2 to the top station 20. In the top station 20, the vehicle is transferred to the running rail 1, whereupon it moves downward, along the path formed by the running rail 1, in curves and loops, under the action of gravitational force, to the base station 10. The amusement ride is located, for example, in a park, over which the passengers located in the vehicles are moved.

The movement path is subdivided into a plurality of sections monitored by sensors, as a result of which it is ensured that a vehicle can move into a further section only as soon as the preceding vehicle has left this section. Otherwise, brakes located in the vehicle are activated and slow down the following vehicle, or bring it to a standstill.

Figure 2B:
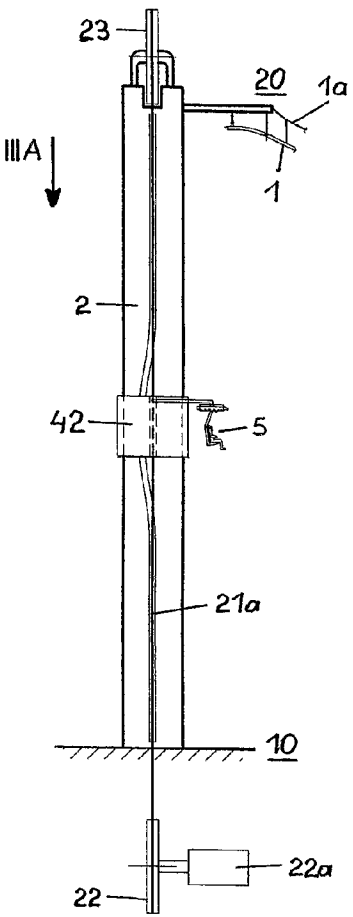
FIGS. 2, 2A and 2B are illustrations of a conveying tower, which forms a constituent part of the amusement ride, in two different views and in different operating positions.
Figure 2A:
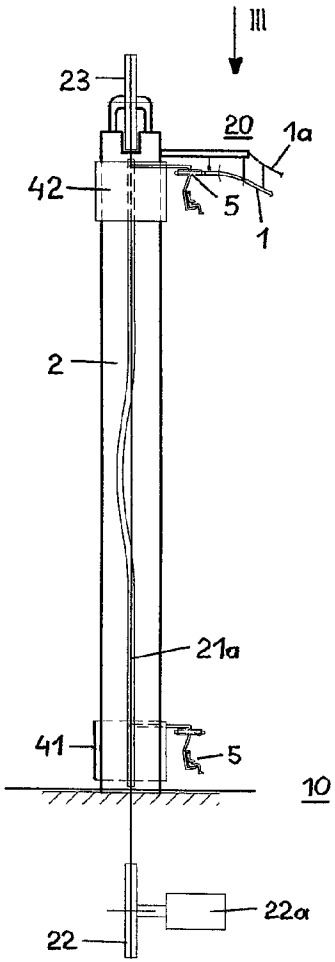
Figure 2:
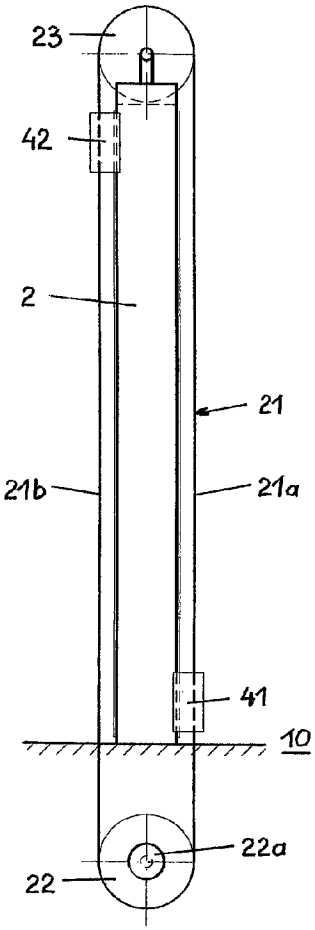

As can be seen from FIGS. 2, 2A and 2B, the conveying tower 2 is assigned a continuous conveying cable 21 which is guided over a drive pulley 22, which is located in the ground, and a deflecting pulley 23, which is located at the top of the conveying tower 2, the drive pulley 22 being assigned a drive motor 22*a*. A respective lifting carriage 41, 42 is guided, along guide rails, on two opposite sides of the conveying tower 2, a first lifting carriage 41 being coupled to a first strand 21*a* of the conveying cable 21 and a second lifting carriage 42 being coupled to the second strand 21*b* of the conveying cable 21.

As can also be seen from FIG. 2A, the lifting carriage 41 located in the region of the base station 10 has received a first vehicle 5 occupied by passengers. In contrast, the region of the top station 20 contains a second vehicle 5 which has been conveyed upward by the lifting carriage 42 and is then transferred to the running rail 1 which leads to the base station 10. Thereafter, the drive pulley 22 is made to move such that the lifting carriage 41, with the first vehicle 5, is moved upward by the strand 21*a* of the conveying cable 21 and the lifting carriage 42 is moved downward by the other cable strand 21*b*. Pivotable carrying arms for the vehicles 5 are provided on the two lifting carriages 41 and 42. In order to avoid collisions between the carrying arms for the vehicles 5, the carrying arms are guided in guide tracks along the movement path of the lifting carriages 41 and 42, as a result of which they are moved apart in order for the two lifting carriages 41 and 42 to move past one another.

Figure 3A:
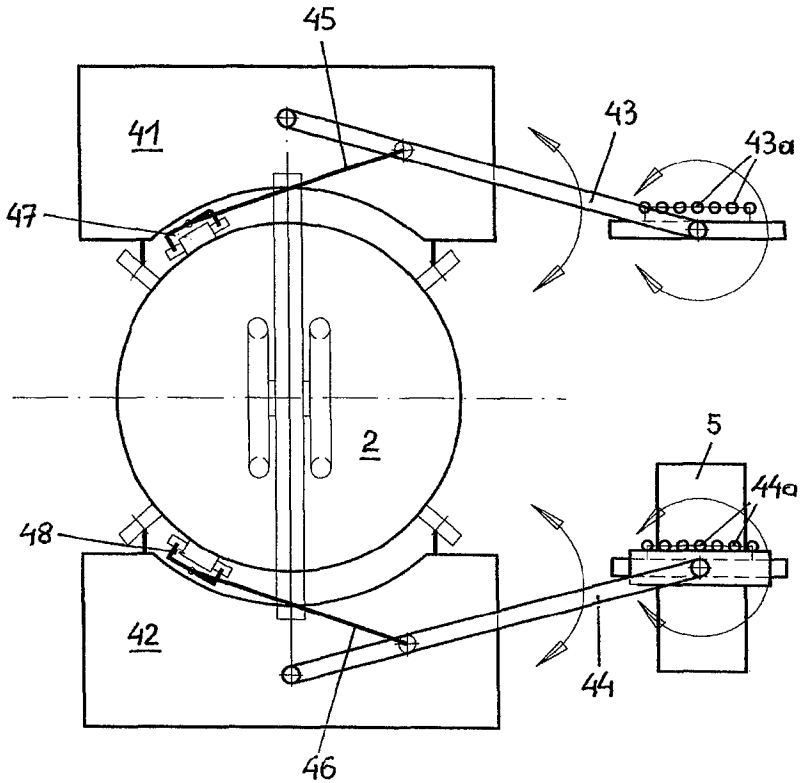
FIGS. 3 and 3A are illustrations showing views in directions of the arrows III-III and IIIA-IIIA from FIGS. 2A and 2B, the views being shown on an enlarged scale in relation to FIGS. 2A and 2B.
Figure 3:
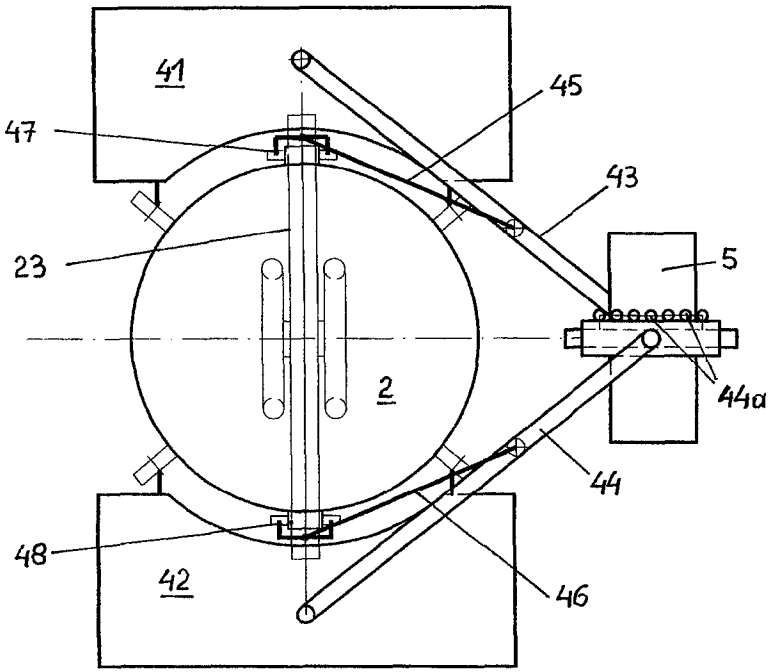

Reference is made, in this respect to FIGS. 3 and 3A, which illustrate the conveying tower 2 and the lifting carriages 41 and 42 which can be displaced along the same. As can be seen from FIGS. 3, 3A, carrying arms 43 and 44 are located on the lifting carriages 41 and 42, it being possible for the carrying arms to be pivoted by links 45 and 46 which are guided along guides 47 and 48. Halfway up the lifting tower 2, the guides 47 and 48 are configured with deflecting measures, as a result of which the carrying arms 43 and 44 for the vehicles 5 are pivoted apart such that, as the lifting carriages 41 and 42 move in opposite vertical directions, these carrying arms 43 and 44 are spaced apart to such a great extent that they can move past one another without any risk of collision.

It should be pointed out here that the carrying arms 43 and 44 can also be pivoted by electric motors or by hydraulic or pneumatic actuating cylinders.

Also provided on each of the carrying arms 43 and 44 is a group of conveying wheels 43*a* and 44*a*, respectively, by which the vehicles 5 can be moved onto the running rail 1.

Figure 4A:
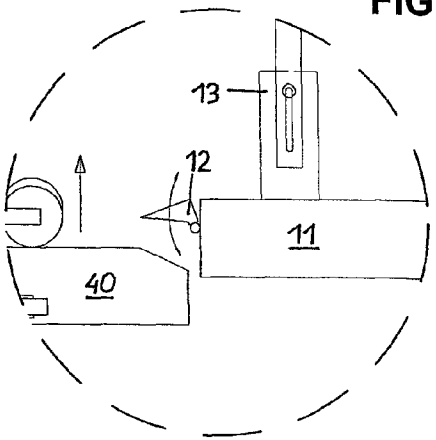
FIGS. 4, 4A and 4B are illustrations showing a configuration of a top end of a conveying tower and two different positions of detail A from FIG. 4, shown on an enlarged scale in relation to FIG. 4.
Figure 4B:
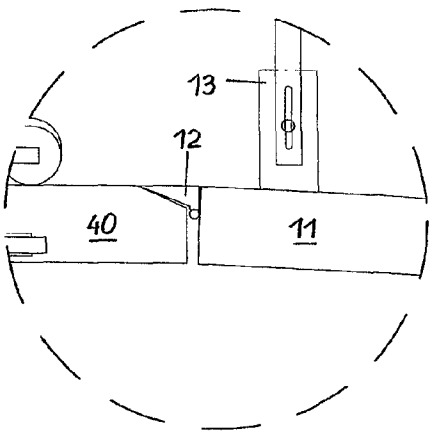
Figure 4:
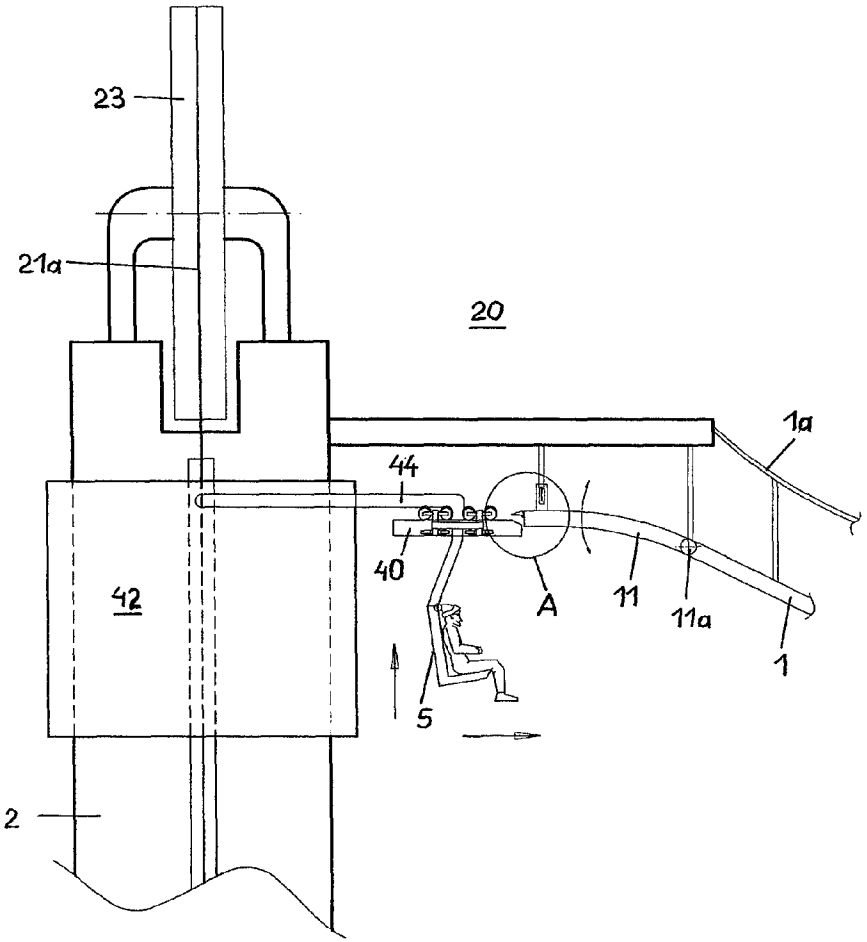

FIGS. 4, 4A and 4B will be used to explain the way in which the vehicle 5 located in the top station 20 is transferred onto the running rail 1 from the lifting carriages 41, 42. As can be seen from FIGS. 4, 4A and 4B, a supporting rail 40, on which the vehicle 5 is located, is provided on the carrying arm 44. Furthermore, the supporting rail 40 is assigned a guide rail 11, which continues the running rail 1 and can be pivoted about an axis 11*a* into different vertical positions. In addition, a pivotable stop 12 for the supporting rail 40 is articulated at the front end of the guide rail 11. It is likewise also the case that the carrying arm 43 is configured with a supporting rail 40, which interacts with the guide rail 11. In order to adjust the height of the guide rail 11, the latter is assigned a slot guide 13.

As soon as the respective supporting rail 40 has reached its top end position by adjustment of one of the lifting carriages 41 and 42, it comes into abutment against the stop 12, as a result of which the vertical position of the guide rail 11 coincides precisely with the supporting rail 40. As soon as the vehicle 5 located in the top station 20 is then moved on in the direction of the running rail 1, by the conveying wheels 43*a*, 44*a*, in order to descend from the top station 20 to the base station 10, it passes smoothly, irrespective of slightly different vertical positions of the supporting rails 40, onto the guide rail 11 and then onto the running rail 1.

Figure 5:
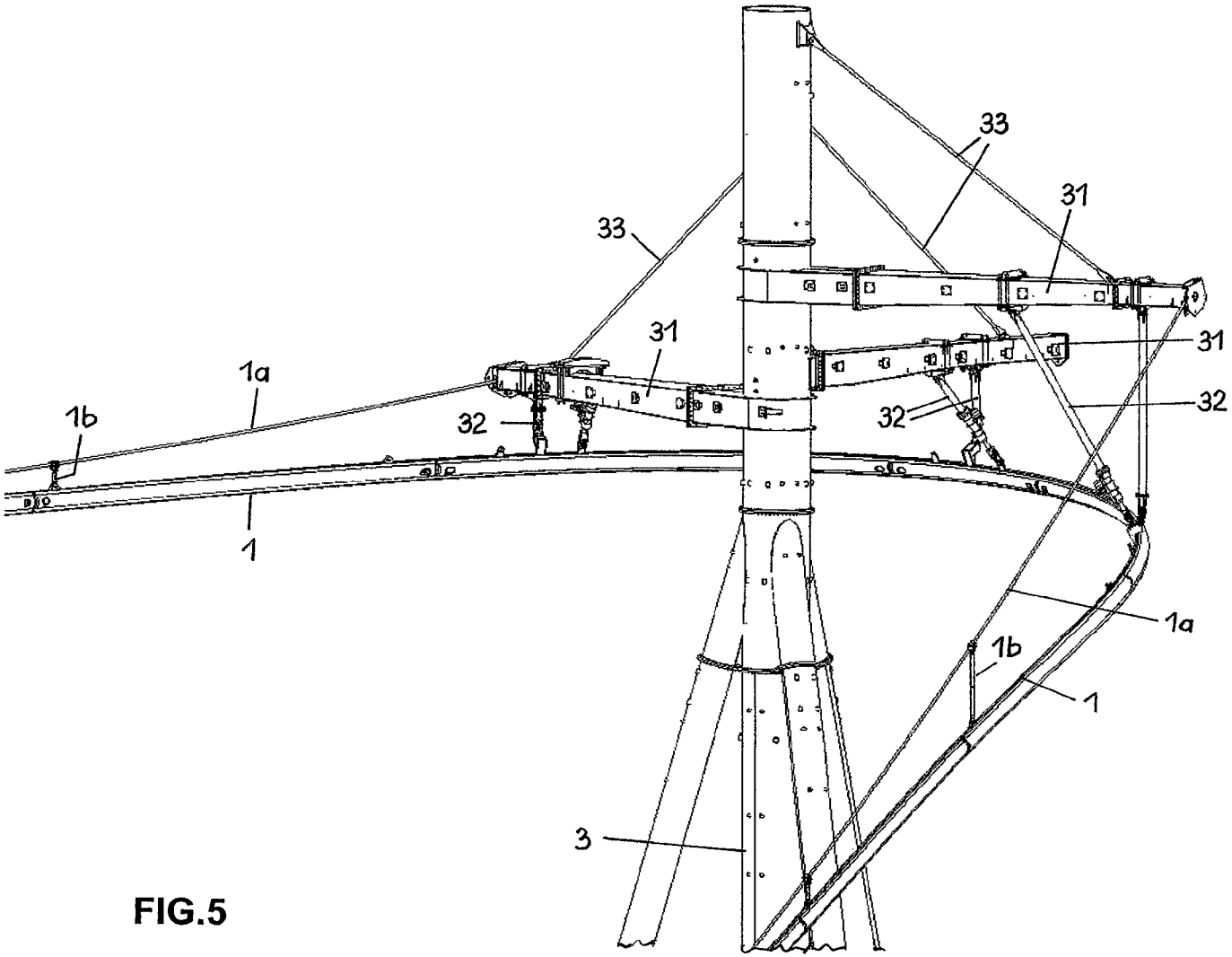
FIGS. 5 and 5A are perspective views of a top end of a running-rail support located in the installation according to FIG. 1.
Figure 5A:
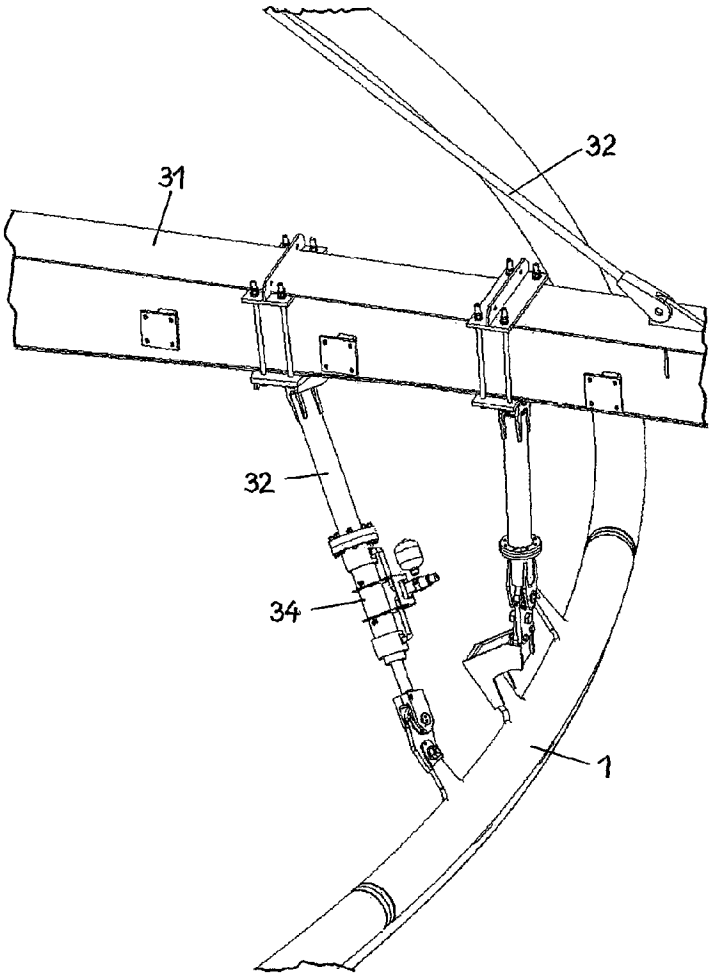

FIGS. 5 and 5A illustrate the fastening of the running rail 1 on one of the supports 3, the running rail 1 being guided around the support 3 through a curve of approximately 180°. For this purpose, the support 3 is configured with a plurality of more or less horizontally projecting supporting arms 31 on which, on the one hand, the supporting cable 1*a* for the running rail 1 is braced and on which, on the other hand, the running rail 1 is fastened by tie rods 32. The supporting arms 31 here are braced by further tie rods 33 fastened on the support 3. It can also be seen from this illustration that the running rail 1 is borne by the supporting cable 1*a* by tie elements 1*b*. As can also be seen from FIG. 5A, the tie rods 32 are configured with hydraulic damping measures 34, which provide for length compensation of the running rail 1 as the transporting device passes through the relevant section. This is possible since the running rail 1 is fastened on the supports 3 such that it can move in relation to the same.

Figure 6A:
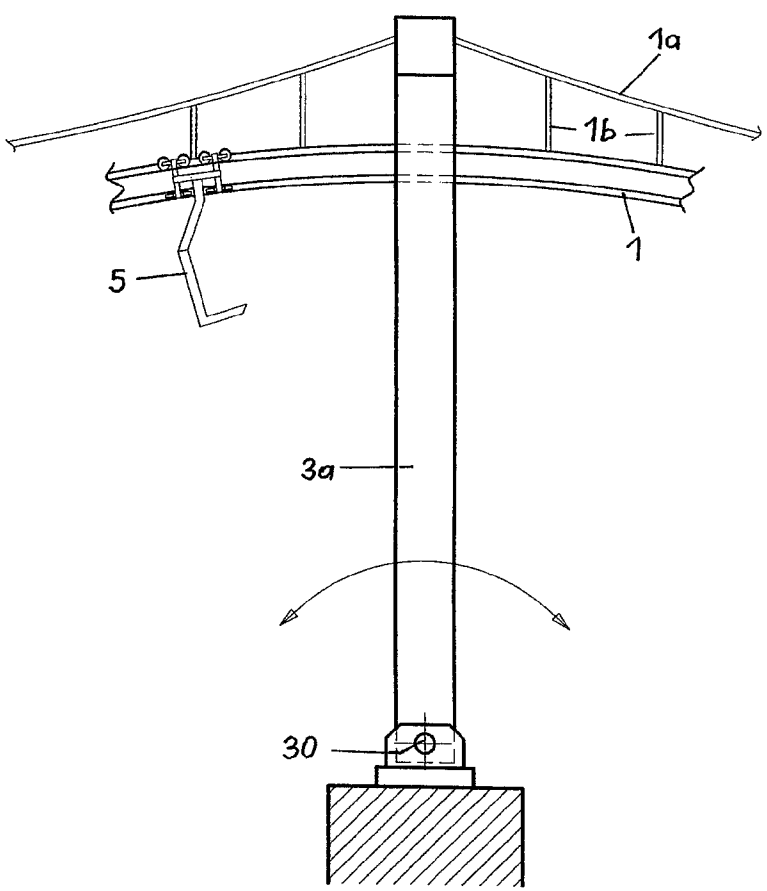
FIGS. 6 and 6A are illustrations showing two different views of a further embodiment of a running-rail support located in the installation according to FIG. 1.
Figure 6:
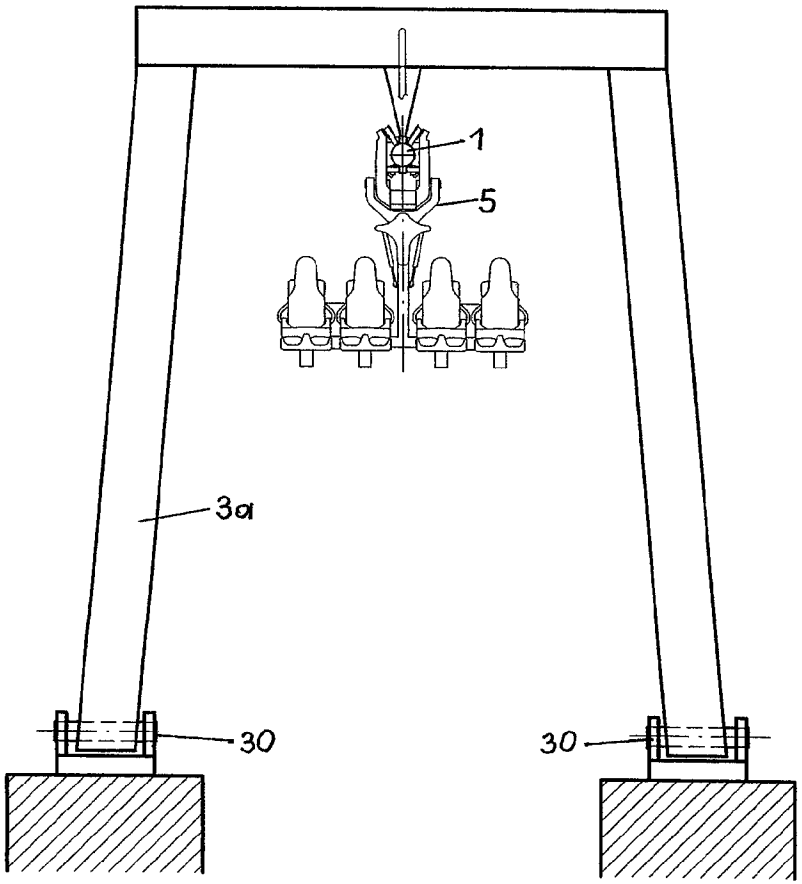

As can also be seen from FIGS. 6 and 6A, the supports 3*a*, which are of gantry-like construction, are mounted at base ends such that they can be pivoted about horizontally oriented axes 30, in which case the supports 3*a* can be moved in the longitudinal direction of the running rail 1, this likewise allowing compensatory movements of the guide rail 1.

Figure 7:
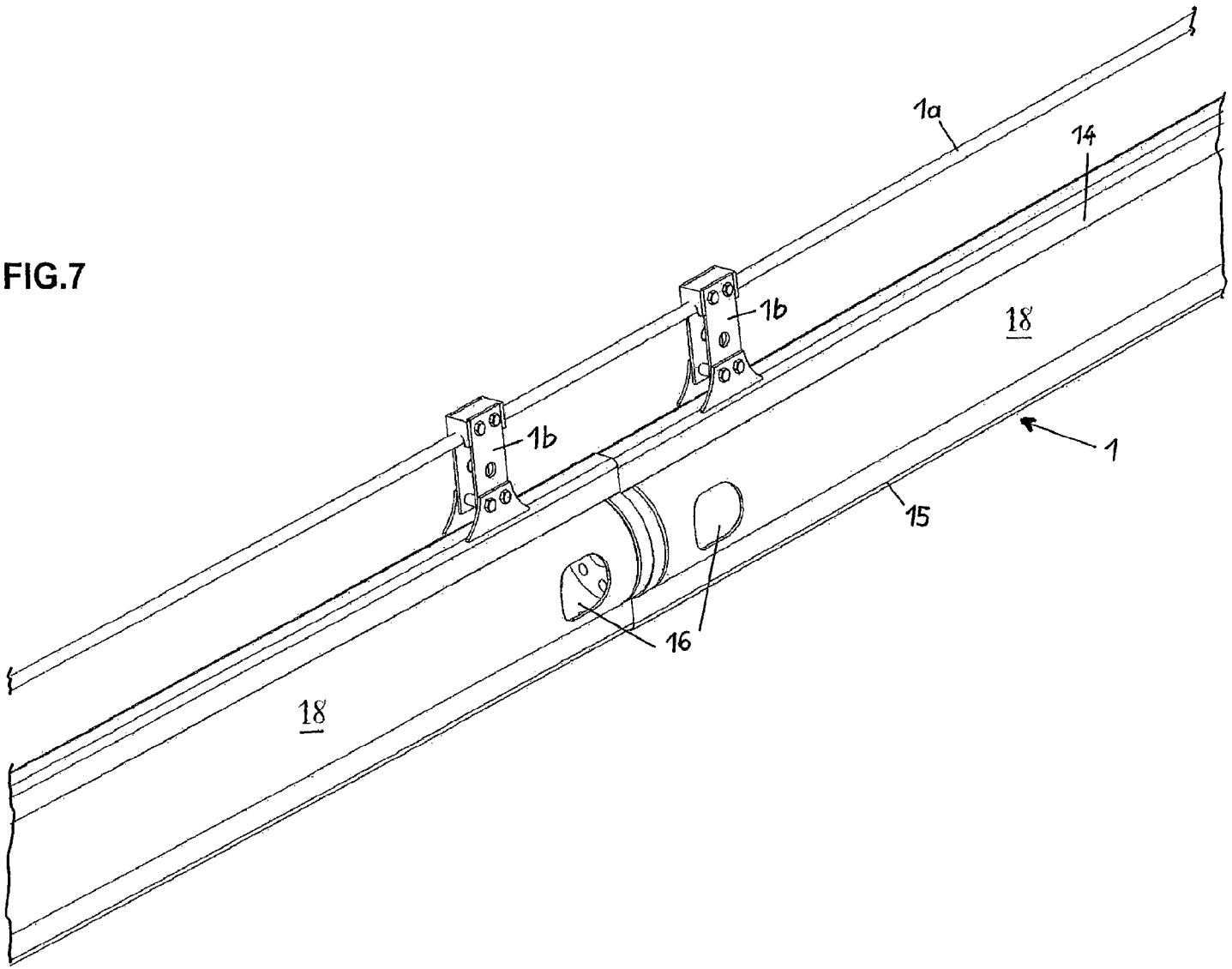
FIG. 7 is a perspective view of the running rail provided in the installation according to FIG. 1.

As can be seen from FIG. 7, the running rail 1 is formed by more or less cylindrical tubular components 18 containing upwardly projecting strips 14 and downwardly projecting strips 15. The carrying elements 1*b*, by which the guide rail 1 is fastened on the supporting cable 1*a*, are fastened on the top strips 14.

Furthermore, the ends of the tubular components 18 contain openings 16 through which two adjoining tubular components 18 can be screwed together.

Figure 8:
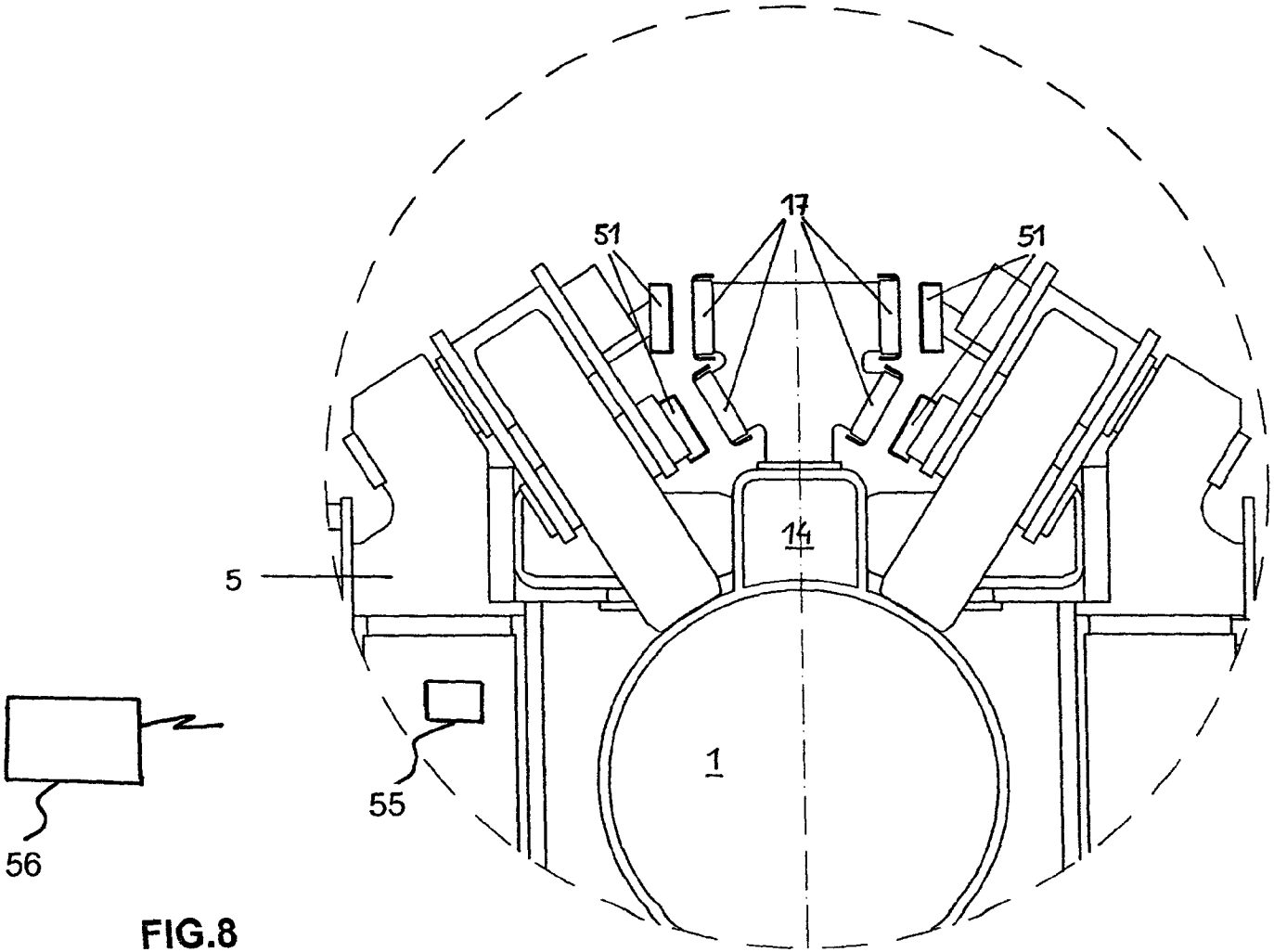
FIG. 8 is an illustration showing a detail of the running rail as seen in a longitudinal direction of the running rail.

As can also be seen from FIG. 8, the top strip 14 of the running rail 1 is configured with groups of control lugs 17, which are assigned to the individual sections of the running rail 1 and are assigned groups of sensors 51, which are located on the vehicles 5. Also provided in the vehicles 5 are receiving and transmitting devices 55 and a power-supply device, which are connected via radio to a central computer 56 located in the base station 10.

By use of the control lugs 17, the sensors 51, which are located on the vehicles 5, receive signals which indicate the respective positions of the vehicles 5 along the guide rail 1 and are transmitted to the central computer 56 via the transmitting devices 55 located in the vehicles 5. The central computer 56 transmits, to the receiving devices 55 located in the vehicles 5, in each case control signals by which the movements of the vehicles 5 can be controlled by virtue of brakes located in these vehicles being triggered. Consequently, the descent of the individual vehicles 5 is either slowed down or, if need be, stopped. The central computer 56 thus controls all of the vehicles 5 located in the installation in respect of the points in time at which they are transferred to the lifting carriages 41, 42 in the base station 10, in respect of the points in time at which they are transferred from the supporting rails 40 onto the running rails 1 in the top station 20 and in respect of the speeds at which they descend along the individual sections of the running rail 1, in which case they can be slowed down or also stopped.

The particular advantage of the system is that all that is required is for groups of control lugs 17, which do not require any power supply, to be provided along the running rail 1, whereas the sensors 51 and the transmitting and receiving devices 55 with the necessary power supply are located on the vehicles 5.

The invention claimed is:

1. An installation for conveying passengers, the installation comprising:

a plurality of supports;

a running rail disposed above ground and supported by said supports;

a transporting device guided by said running rail;

a base station having a boarding location for the passengers and a disembarking location for the passengers;

a top station defining a transfer location;

a conveying tower for conveying said transporting device from said base station to said top station, said running rail starting from said top station and running predominantly downward, said running rail extending along curves and loops from said top station to said base station, said conveying tower having an upward-conveying apparatus for conveying said transporting device occupied by the passengers;

said upward-conveying apparatus having at least one lifting carriage for moving said transporting device occupied by the passengers from said base station to said top station with said transfer location;

said at least one lifting carriage having a carrying arm for said transporting device, said carrying arm being pivotable in at least a more or less horizontal plane and pivoting said transporting device at least more or less in a plane normal to a lifting movement; and at said transfer location of said top station, said transporting device occupied by the passengers being transferred from said upward-conveying apparatus to said running rail, along said running rail the passengers descend to said disembarking location of said base station.

2. The installation according to claim 1, wherein said upward-conveying apparatus has two lifting carriages which can be simultaneously adjusted in height in opposite directions.

3. The installation according to claim 2, wherein said conveying tower has a deflecting roller and a conveying cable guided over said deflecting roller, said two lifting carriages are coupled to one another for movement in opposite directions by said conveying cable.

4. The installation according to claim 1, wherein:

said conveying tower has pivoting means selected from the group consisting of a guide rail, a motor, and an actuating cylinder; and said carrying arm is disposed on said at least one lifting carriage, and can be pivoted by said pivoting means.

5. The installation according to claim 2, wherein said conveying tower is a lifting tower having two guide rails disposed on two opposite sides of said lifting tower; and said two lifting carriages are assigned to said two guide rails.

6. The installation according to claim 2, wherein said running rail, which leads away from said top station and said running rail which leads into said base station encloses an acute or an obtuse angle with respect to a direction of a lifting movement of said lifting carriages.

7. The installation according to claim 1, further comprising:

groups of control lugs disposed along said running rail;

sensors associated with said groups of control lugs and disposed on said transporting device;

a central control unit disposed in said base station for controlling movements of said transporting device located in the installation; and receiving and transmitting devices disposed on said transporting device communicating with said central control unit for controlling movements of said transporting device.

8. The installation according to claim 7, wherein said receiving and transmitting devices communicate with said central control unit wirelessly.

9. The installation according to claim 7, wherein said receiving and transmitting devices communicate with said central control unit via radio.

* * * * *